US009151132B2

(12) United States Patent
Nguyen

(10) Patent No.: US 9,151,132 B2
(45) Date of Patent: Oct. 6, 2015

(54) METHOD AND SYSTEM FOR SETTING A METAL SEAL

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 281 days.

(21) Appl. No.: 13/063,928

(22) PCT Filed: Oct. 7, 2009

(86) PCT No.: PCT/US2009/059871

§ 371 (c)(1),
(2), (4) Date: Mar. 14, 2011

(87) PCT Pub. No.: WO2010/056439

PCT Pub. Date: May 20, 2010

(65) Prior Publication Data

US 2011/0169224 A1 Jul. 14, 2011

Related U.S. Application Data

(60) Provisional application No. 61/114,961, filed on Nov. 14, 2009.

(51) Int. Cl.

| | |
|---|---|
| ***F16L 17/00*** | (2006.01) |
| ***E21B 33/04*** | (2006.01) |
| ***E21B 33/03*** | (2006.01) |

(52) U.S. Cl.

CPC ..... *E21B 33/04* (2013.01); *E21B 33/03* (2013.01)

(58) Field of Classification Search

USPC ..... 277/314, 336, 329; 166/84.1

See application file for complete search history.

(56) References Cited

U.S. PATENT DOCUMENTS

| | | | | | |
|---|---|---|---|---|---|
| 3,924,679 | A | | 12/1975 | Jansen, Jr. | |
| 4,284,142 | A | * | 8/1981 | Kirkland | 166/344 |
| 4,556,224 | A | | 12/1985 | Le | |
| 4,561,499 | A | * | 12/1985 | Berner et al. | 166/341 |
| 4,588,029 | A | * | 5/1986 | Blizzard | 166/120 |
| 4,641,841 | A | * | 2/1987 | Regan | 277/336 |
| 4,650,225 | A | * | 3/1987 | Le et al. | 285/348 |
| 4,653,589 | A | * | 3/1987 | Alandy | 166/382 |
| 4,718,679 | A | * | 1/1988 | Vyvial | 277/328 |
| 4,749,035 | A | * | 6/1988 | Cassity | 277/340 |
| 4,794,988 | A | * | 1/1989 | van Bilderbeek | 166/345 |
| 4,823,871 | A | * | 4/1989 | McEver et al. | 166/182 |
| 4,938,289 | A | * | 7/1990 | Van Bilderbeek | 166/342 |

(Continued)

OTHER PUBLICATIONS

PCT Search Report and Written Opinion of PCT Application No. PCT/US2009/059871 mailed Jun. 18, 2010.

*Primary Examiner* — Kristina Fulton
*Assistant Examiner* — Eugene G Byrd
(74) *Attorney, Agent, or Firm* — Fletcher Yoder, P.C.

(57) ABSTRACT

A system and method is provided for setting a metal-to-metal seal (e.g., in an annular space between wellhead components) using a temporary elastomer seal. For example, the annular space may be sealed with one or more elastomer seals before hydraulically setting the metal-to-metal seal. A seal assembly may include the elastomer seals and the metal-to-metal seal. Positioning the seal assembly in the annular space between the wellhead components may isolate pressure in the annular space below the seal such that the metal-to-metal seal may be set. In an exemplary embodiment, a hydraulic mechanism axially compresses the metal-to-metal seal between two members of the seal assembly, thereby radially expanding and setting the metal-to-metal seal.

18 Claims, 8 Drawing Sheets

(56) References Cited

U.S. PATENT DOCUMENTS

| | | | | | |
|---|---|---|---|---|---|
| 5,080,174 | A | | 1/1992 | Hynes | |
| 5,114,158 | A | * | 5/1992 | Le | 277/314 |
| 5,158,326 | A | | 10/1992 | Anderson et al. | |
| 5,325,925 | A | * | 7/1994 | Smith et al. | 166/387 |
| 5,364,110 | A | * | 11/1994 | Streich et al. | 277/336 |
| 5,524,710 | A | | 6/1996 | Shinn | |
| 6,648,335 | B1 | * | 11/2003 | Ezell | 277/438 |
| 6,969,070 | B2 | * | 11/2005 | Reimert et al. | 277/323 |
| 7,028,777 | B2 | * | 4/2006 | Wade et al. | 166/343 |
| 7,111,688 | B2 | * | 9/2006 | vanBilderbeek | 166/382 |
| 7,861,789 | B2 | * | 1/2011 | Nelson | 166/348 |
| 8,006,764 | B2 | * | 8/2011 | Adamek et al. | 166/348 |
| 8,146,670 | B2 | * | 4/2012 | Ellis et al. | 166/379 |
| 8,205,670 | B2 | * | 6/2012 | Nelson | 166/84.1 |
| 2005/0051342 | A1 | | 3/2005 | Campbell et al. | |
| 2006/0042791 | A1 | | 3/2006 | Hosie et al. | |

* cited by examiner

METHOD AND SYSTEM FOR SETTING A METAL SEAL

CROSS-REFERENCE TO RELATED APPLICATIONS

This application claims priority to and benefit of PCT Patent Application No. PCT/US2009/059871, entitled "Method and System for Setting a Metal Seal," filed Oct. 7, 2009, which is herein incorporated by reference in its entirety, and which claims priority to and benefit of U.S. Provisional Patent Application No. 61/114,961, entitled "Method and System for Setting a Metal Seal", filed on Nov. 14, 2008, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as casings, trees, manifolds, and the like, that facilitate drilling and/or extraction operations.

The wellhead components may be coupled together, for example, via a flange coupling, a FastLock Connector (available from Cameron International Corporation, Houston, Tex.), or any suitable fastening system. In addition, it may be desirable to employ a metal-to-metal seal (i.e., a seal without elastomeric components) between wellhead components. Metal seals are well-suited to withstand high temperatures and pressures, thermal cycling, and harsh chemicals. Accordingly, it may be desirable to enable quick and easy setting of the metal seals between the wellhead components while maintaining pressure within the wellhead.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present technique include a system and method that addresses one or more of the above-mentioned challenges of setting metal seals in a mineral extraction system. As explained in greater detail below, the disclosed embodiments include a wellhead sealing assembly that includes a temporary elastomer seal in addition to a metal-to-metal seal. The elastomer seal may be used to temporarily seal the wellhead while the metal-to-metal seal is set hydraulically. In order to set the metal-to-metal seal, the seal assembly may include two or more members surrounding the metal-to-metal seal. Axial movement of one of the members relative to the other (e.g., via a hydraulic mechanism) may axially compress and radially expand the metal-to-metal seal, thereby setting the seal. In addition, a retainer ring may secure the seal assembly in the set position while pressure is being applied.

Figure 1:
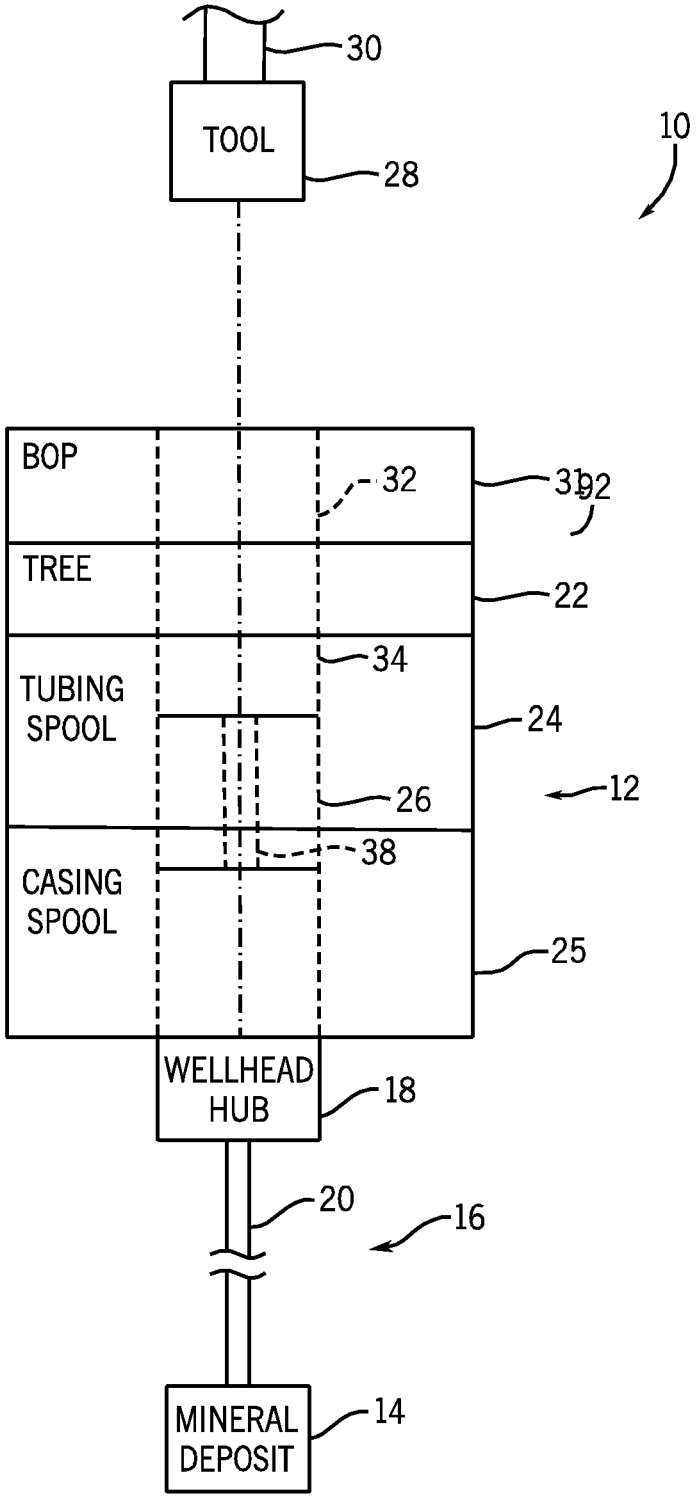
FIG. 1 is a block diagram illustrating a mineral extraction system in accordance with an embodiment of the present invention.

FIG. 1 is a block diagram that illustrates an embodiment of a mineral extraction system 10. As discussed below, one or more metal-to-metal seals may be employed throughout the system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and designed to connect the wellhead 12 to the well 16.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore 20. In the illustrated embodiment, the wellhead 12 includes what is colloquially referred to as a Christmas tree 22 (hereinafter, a tree), a tubing spool 24, a casing spool 25, and a hanger 26 (e.g., a tubing hanger and/or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 31 may also be included, either as a part of the tree 22 or as a separate device. The BOP may consist of a variety of valves, fittings, and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 34. The tubing spool bore 34 connects (e.g., enables fluid communication between) the tree bore 32 and the well 16. Thus, the tubing spool bore 34 may provide access to the well bore 20 for various completion and workover procedures. For example, components can be run down to the wellhead 12 and disposed in the tubing spool bore 34 to seal off the well bore 20, to inject chemicals down-hole, to suspend tools down-hole, to retrieve tools down-hole, and so forth.

As will be appreciated, the well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead 12 to secure tubing and casing suspended in the well bore 20, and to provide a path for hydraulic control fluid, chemical injections, and so forth. The hanger 26 includes a hanger bore 38 that extends through the center of the hanger 26, and that is in fluid communication with the tubing spool bore 34 and the well bore 20. One or more seals, such as metal-to-metal seals, may be disposed between the hanger 26 and the tubing spool 24 and/or the casing spool 25.

Figure 2:
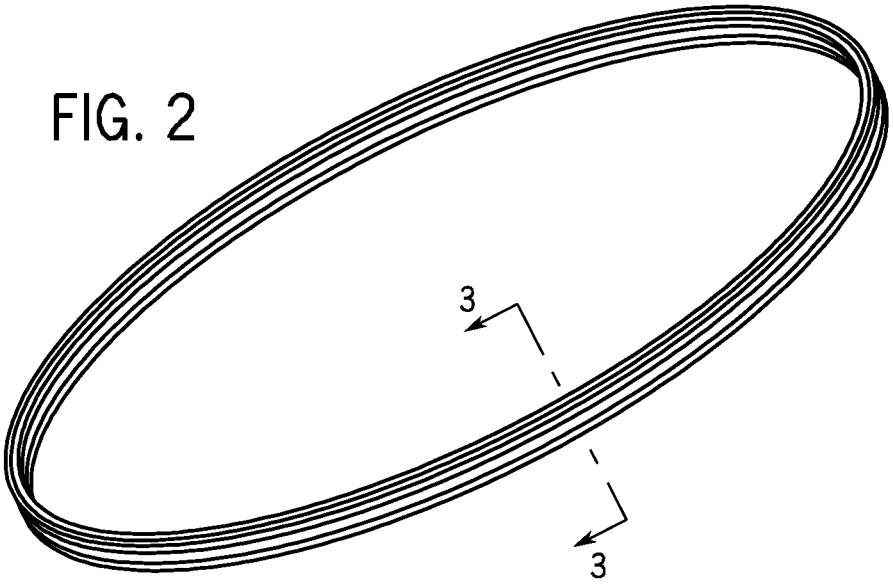
FIG. 2 is a perspective view of a CANH seal in accordance with an embodiment of the present invention.
Figure 3:
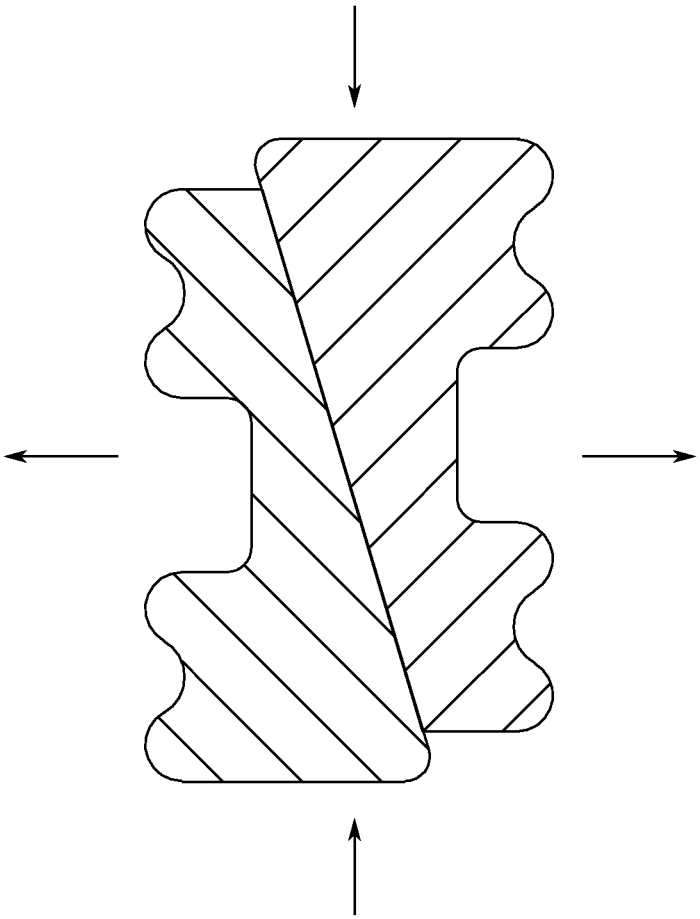
FIG. 3 is a cross-sectional view of the CANH seal of FIG. 2 taken along a line 3-3.

FIGS. 2 and 3 illustrate an exemplary metal-to-metal seal 50 known as a CANH seal (available from Cameron International Corporation, Houston, Tex.). As will be appreciated, disclosed embodiments demonstrate setting the exemplary CANH seal; however, other metal-to-metal seals may be set using the described method and/or system. As illustrated in FIG. 2, the CANH seal includes two concentric metal ring components 52 and 54. The components 52 and 54 may have a generally wedge-shaped cross-section, as illustrated in FIG. 3. Complimentary frusto-conical surfaces 56 and 58 on the ring components 52 and 54, respectively, may enable the components 52 and 54 to fit together (e.g., wedge together) to form the metal-to-metal seal 50. The seal 50 may be disposed in an annular space between wellhead components, as described in more detail below. By applying axial pressure to the seal 50 (i.e., along the lines 60), the components 52 and 54 are pressed together and expand radially (i.e., along the lines 62). The radial expansion of the ring components 52 and 54, as well as the tight metal-to-metal seal between the components 52 and 54, ensures a secure metal seal between wellhead components.

Figure 4:
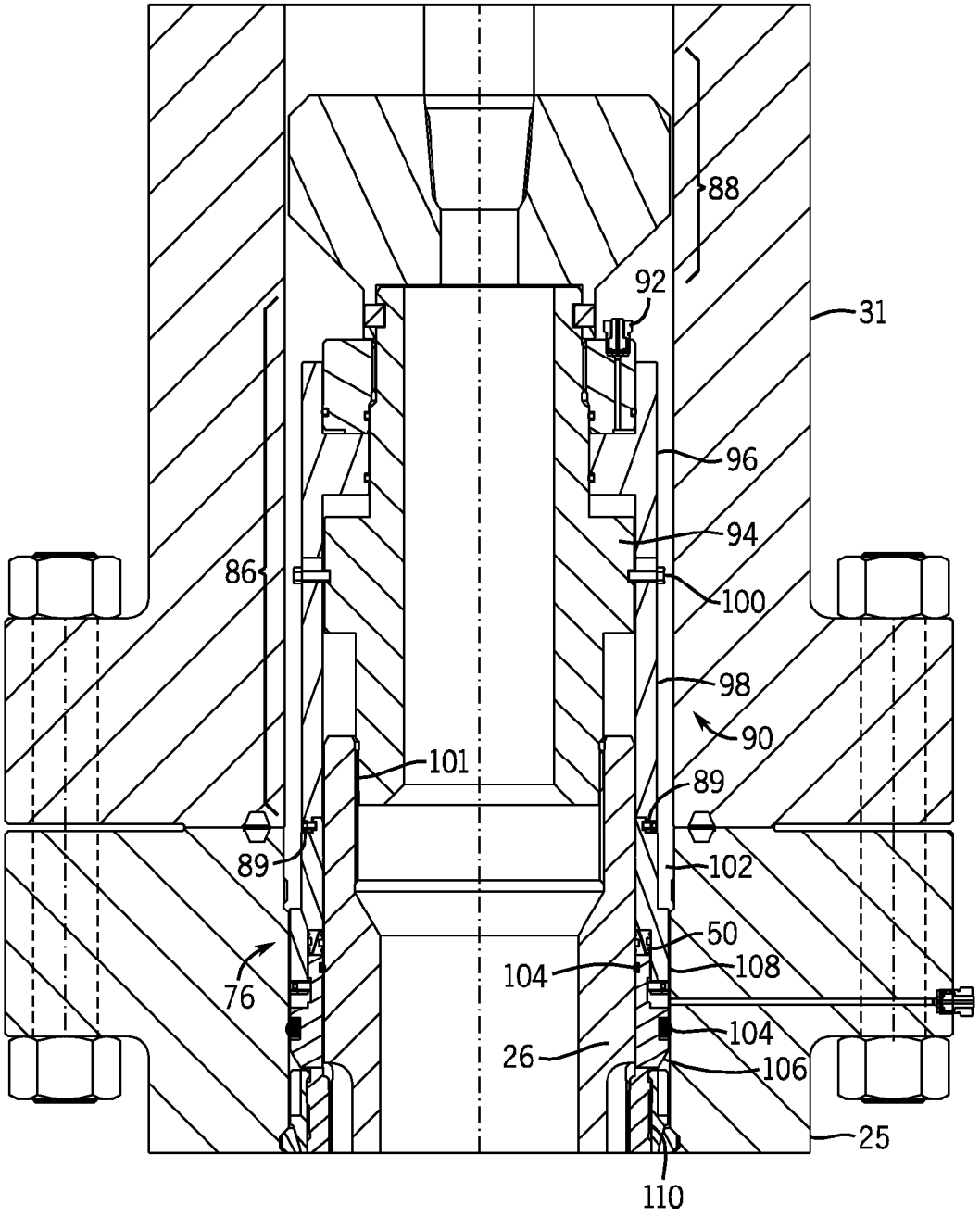
FIGS. 4-9 are cross-sectional views of components of the mineral extraction system of FIG. 1 in accordance with an embodiment of the present invention.

FIGS. 4-9 illustrate various steps for setting a metal seal in accordance with the disclosed embodiments. For example, FIG. 4 is a cross-sectional view of exemplary wellhead components. In the illustrated embodiment, a seal assembly 76, including the metal-to-metal seal 50, may be installed through the BOP 31 around a hanger 26 disposed in the casing spool 25. In the illustrated embodiment, the BOP 31 and the hanger 26 are coupled together via a flange coupling 85, although other techniques for coupling the wellhead components may be employed. The seal assembly 76 may be run into the hanger 26 by a lower running tool 86 coupled to an upper running tool 88. In the illustrated embodiment, the lower running tool 86 is coupled to the seal assembly 76 via one or more set screws 89. The upper running tool 88 may be separable from the lower running tool 86, as described in more detail below.

In addition, the lower running tool 86 may include a hydraulic mechanism 90 to apply pressure to the metal-to-metal seal 50. The hydraulic mechanism 90 may include, for example, a hydraulic port 92 through which fluid may be introduced to apply pressure to an exterior of a tool body 94 and a movable piston 96 disposed concentrically around the tool body 94. The movable piston 96 may in turn act on a movable sleeve 98. In another embodiment, the piston 96 and the sleeve 98 may be a single component. The movable sleeve 98 may be secured to the tool body 94 via one or more removable fasteners 100 (e.g., cap screws).

As illustrated in FIG. 4, the lower running tool 86 may be coupled to the seal assembly 76 and the upper running tool 88. The upper running tool 88 may be used to run the seal assembly 76 through the BOP 31 and into the casing spool 25. The upper running tool 88 may then rotate the lower running tool 86 with respect to the hanger 26 to engage and secure a threading 101 thereon. The seal assembly 76 serves to seal an annular space 102 between the casing spool 25 and the hanger 26. Accordingly, in addition to the metal-to-metal seal 50, one or more elastomer seals 104 may also be included in the seal assembly 76 to temporarily seal the annular space 102 before the metal-to-metal seal 50 is set, as described in more detail below.

In addition to the seals 50 and 104, the seal assembly 76 may include an abutting member 106 and a compressing member 108. The abutting member 106 may abut a ring 110 which secures the hanger 26 to the casing spool 25. When the seal assembly is run into the casing spool 25, the abutting member 106 may abut the ring 110, thereby stopping further advancement of the seal assembly 76 into the wellhead. The abutting member 106 may remain in this position while the metal-to-metal seal 50 is set, as described in more detail below. Accordingly, the temporary elastomer seals 104 may be disposed partially within and protruding from the abutting member 106. The compressing member 108 may be movably coupled to the abutting member 106, for example, via a pin-and-slot connector. In addition, the metal-to-metal seal 50 may be disposed between the abutting member 106 and the compressing member 108, as will be described further below.

After running the seal assembly 76 into the casing spool 25 and securing the lower running tool 86 to the hanger 26, the upper running tool 88 may be disengaged from the lower running tool 86 and removed from the wellhead. That is, the upper running tool 88 may be removably coupled to the lower running tool 86, for example, via a pin-and-groove connector, such as a J-slot, or any suitable connector. The upper running tool 88 may be disengaged from the lower running tool 86 by rotational movement followed by axial movement. Upon disengaging from the lower running tool 86, the upper running tool 88 may be retrieved from the wellhead.

Figure 5:
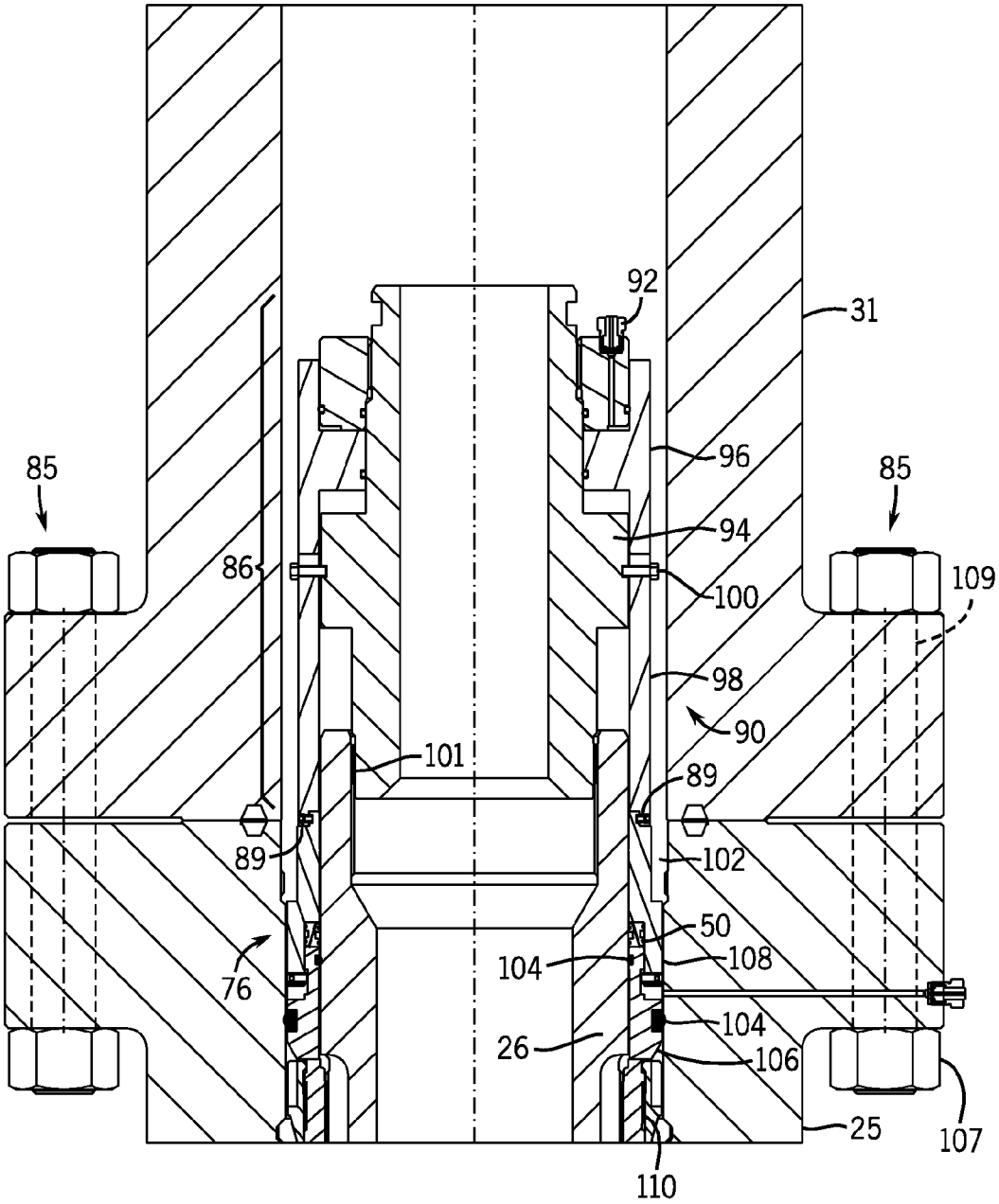
Figure 6:
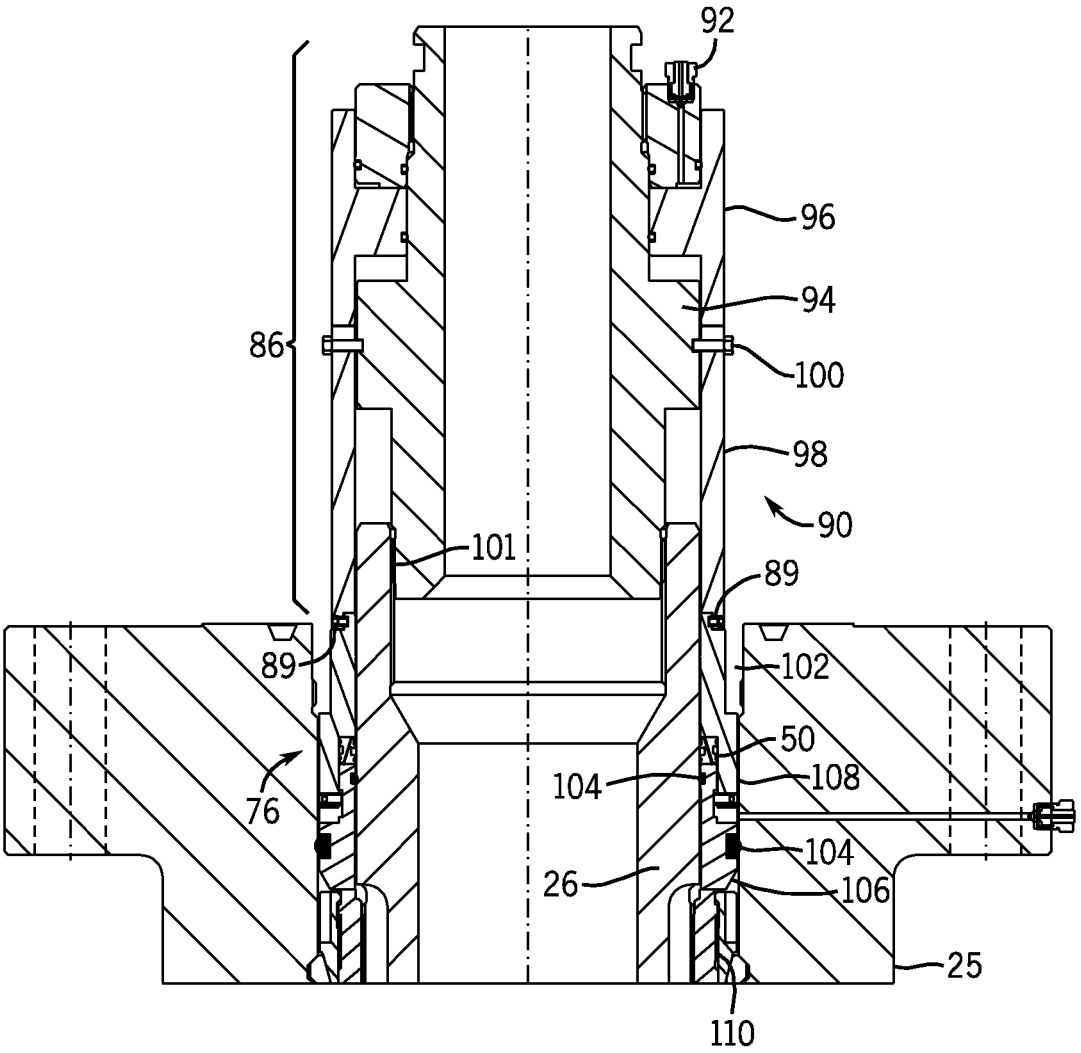

With the upper running tool 86 removed, as illustrated in FIG. 5, the BOP 31 may also be uncoupled from the casing spool 25 and removed from the wellhead. For example, the flange coupling 85 may be uncoupled by removing a threaded coupler 107 (e.g., a nut) from a threaded shaft 109 (e.g., a bolt). With the flange coupling 85 disengaged, the BOP 31 may be lifted axially from the casing spool 25, as illustrated in FIG. 6. Again, it should be noted that the metal metal-to-metal seal 50 may be unset when the BOP 31 is removed. The elastomer seals 104 are configured to provide adequate temporary sealing for the annular space 102 while the wellhead components are being installed and set for use.

Figure 7:
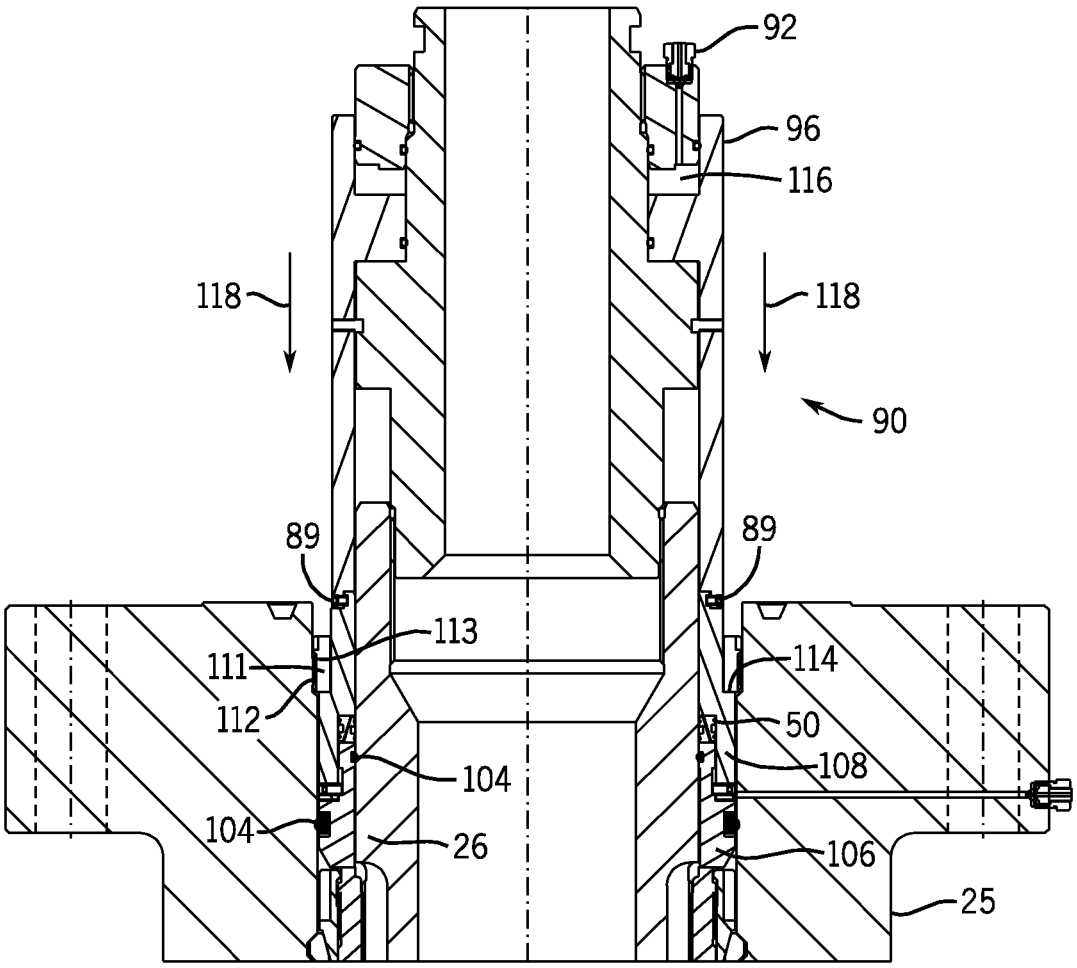

With the BOP 31 removed, the metal-to-metal seal 50 may be set, as illustrated in FIG. 7. A retainer ring 111 may be lowered into the casing spool 25 around the lower running tool 86 and the seal assembly 76. In the illustrated embodiment, the retainer ring 111 may have external threading 112 which cooperates with internal threading 113 in the casing spool 25. The retainer ring 111 may therefore be secured to the casing spool 25, for example, by rotation of the retainer ring 111 relative to the casing spool 25. Advancement of the retainer ring 111 into the casing spool 25 may result in abutment of the retainer ring 111 against a shoulder 114 on the compressing member 108 of the seal assembly 76. Because the metal-to-metal seal 50 is set via hydraulic pressure, as described below, the retainer ring 111 may be advanced into the casing spool 25 via simple manual rotation, such as by hand, to temporarily secure the seal assembly to the spool.

As described above, the compressing member 108 is capable of moving relative to the abutting member 106. To facilitate this movement, the hydraulic mechanism 90 may apply pressure to the compressing member 108. As illustrated in FIG. 7, the fasteners 100 may be removed from the hydraulic mechanism 90, thereby enabling movement of the piston 96 relative to the tool body 94. Fluid may be applied to the system through the hydraulic port 92, resulting in an increase in pressure in a gap 116 between the port 92 and the piston 96. The piston 96 may then move downward (i.e., in a direction 118), pushing the compressing member 108 downward.

The metal-to-metal seal 50 disposed between the members 106 and 108 may be compressed axially as the compressing member 108 is moved downward (i.e., in the direction 118) by the piston 96. As described above, axial force on the metal-to-metal seal 50 results in radial expansion of the seal 50, thereby setting the metal-to-metal seal 50. In addition, while pressure is applied inside the hydraulic mechanism 90, the retainer ring 111 may be advanced further into the casing spool 25, thereby blocking upward movement of the compressing member 108. Accordingly, while the metal-to-metal seal 50 is axially compressed, the retainer ring 111 is advanced into the casing spool 25 to hold the compressing member 108 in place, thereby setting the metal-to-metal seal 50. Because the metal-to-metal seal 50 is set before the retainer ring 111 is advanced into the casing spool 25, the pressure required to secure the retainer ring 111 need not be great enough to also set the seal 50. That is, reduced force may be used to advance the retainer ring 111 into the casing spool 25.

Figure 8:
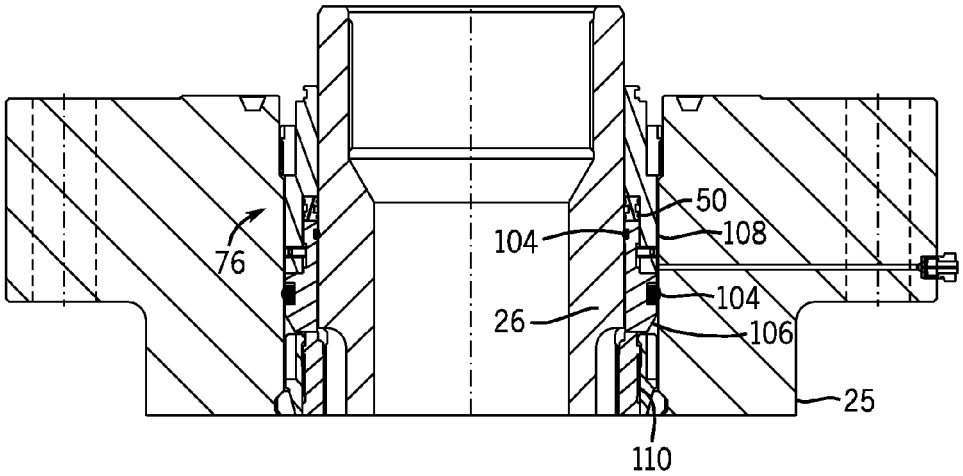

After the metal-to-metal seal 50 is set and the retainer ring 11 is secured, the lower running tool 86, including the hydraulic mechanism 90, may be disengaged from the seal assembly 76 and the hanger 26 and removed from the wellhead. For example, the retainer screws 89 may be removed to enable rotation of the lower running tool 86 with respect to the seal assembly 76. The threading 101 may then be disengaged via rotation, and the lower running tool 86 may be lifted axially away from the hanger 26, as illustrated in FIG. 8.

Figure 9:
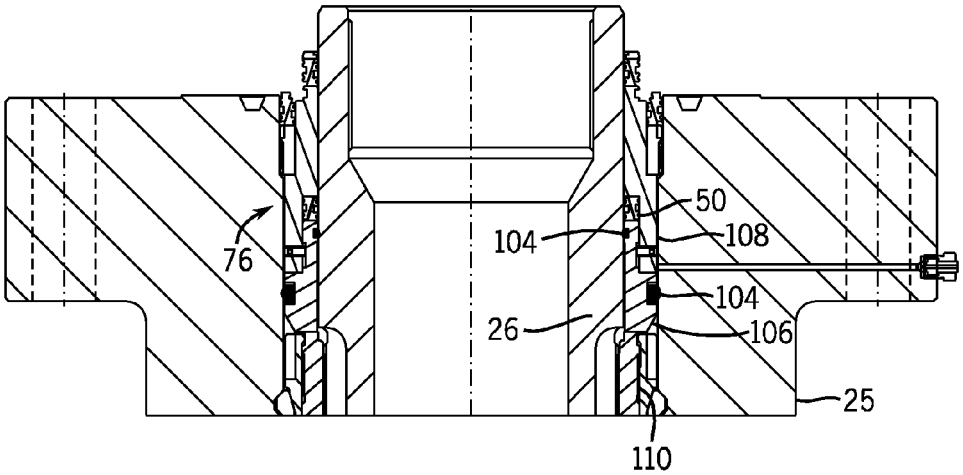

Additional metal-to-metal seals 50 may be disposed around the hanger 26 and/or in the annular space 102 between the hanger 26 and the casing spool 25, as illustrated in FIG. 9. For example, an additional metal-to-metal seal 50 may be disposed between the seal assembly 76 and the casing spool 25 above the retainer ring 111. Another metal-to-metal seal 50 may be disposed around the hanger 26 above the seal assembly 76. The tubing spool 24, or any other suitable wellhead component, may be installed on the casing spool 25. Similar or alternative methods from those described herein may be employed to set the additional metal-to-metal seals 50. The retainer ring 111, in conjunction with the compressing member 108, the abutting member 106, and the ring 110, may ensure that the metal-to-metal seal 50 remains compressed, and therefore set, during operation of the wellhead 10.

Figure 10:
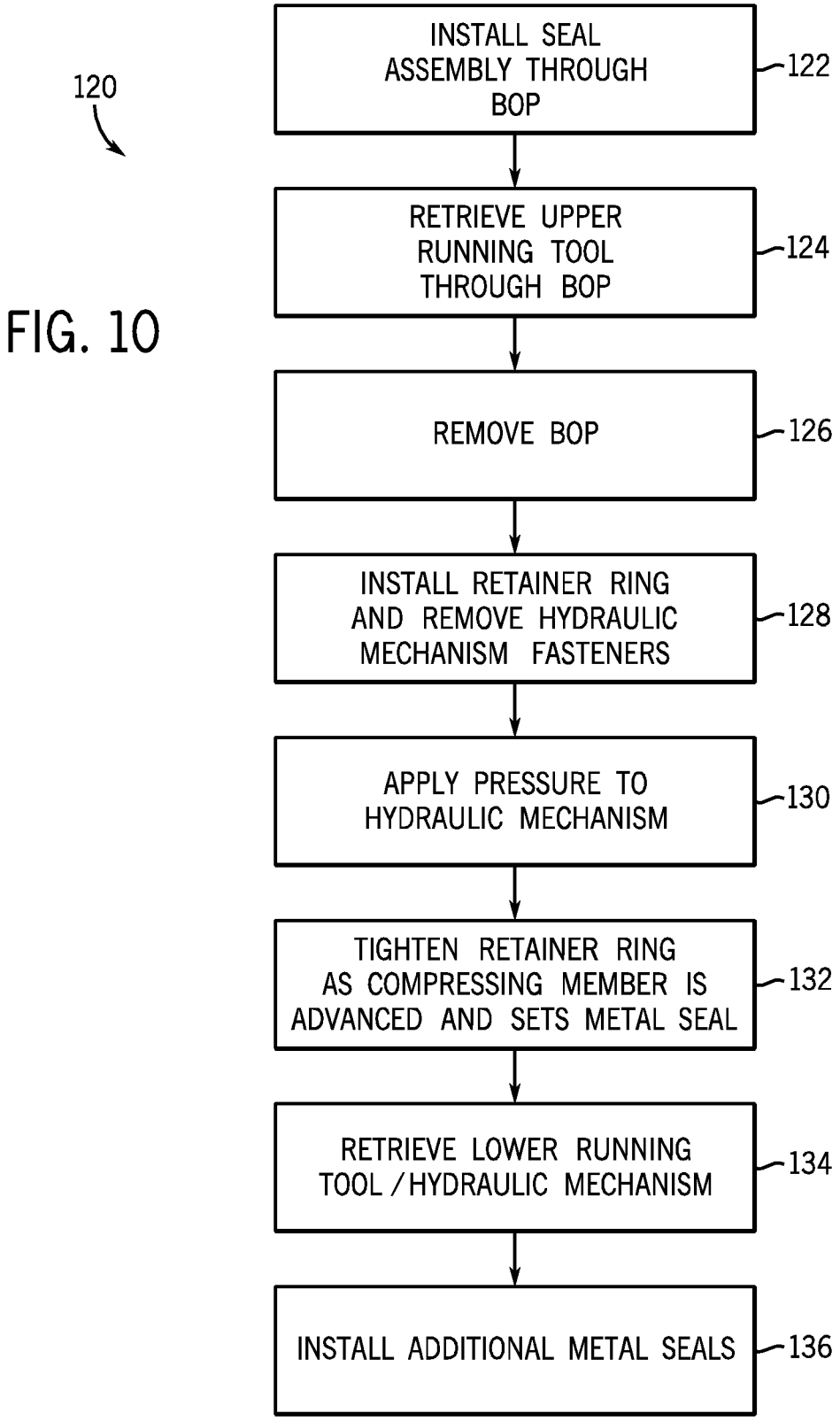
FIG. 10 is a flow chart of an exemplary process for hydraulically setting a metal-to-metal seal as illustrated in FIGS. 4-9 in accordance with an embodiment of the present invention.

FIG. 10 illustrates an exemplary method 120 for setting a metal-to-metal seal, as illustrated in FIGS. 4-9. In the illustrated method 120, the seal assembly 76 may be installed through the BOP 31 (block 122). The upper running tool 88 may then be retrieved through the BOP 31 (block 124), and the BOP 31 may be removed (block 126). The retainer ring 111 may be installed around and abutting the seal assembly 76 (block 128). In addition, before or after installation of the retainer ring 111, the fasteners 100 securing the piston 96 of the hydraulic assembly 90 in place relative to the body 94 of the lower running tool 86 may be removed (block 128). Pressure may then be applied via the hydraulic port 92, thereby moving the compressing member 108 down relative to the abutting member 106 and compressing the metal-to-metal seal 50 (block 130). While pressure is applied to the hydraulic mechanism 90, the retainer ring 111 may be tightened against the compressing member 108 to secure the compressing member 108 in the compressed state, thereby retaining the metal-to-metal seal 50 in the set position (block 132). The lower running tool 86, including the hydraulic mechanism 90, may then be retrieved from the wellhead 12 (block 134). Additional metal-to-metal seals 50 may be installed, as well as additional wellhead components (block 136).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a seal assembly configured to seal between a first tubular component and a second tubular component of a mineral extraction system, the seal assembly comprising:

a metal-to-metal seal comprising a first annular portion coaxial with a second annular portion and interfacing one another along respective frustoconical surfaces;

a first sleeve disposed on a first axial side of the metal-to-metal seal, wherein the first sleeve is configured to be disposed within the first tubular component and between the first tubular component and the second tubular component;

a second sleeve comprising an inner surface and an outer surface, wherein the second sleeve is disposed on a second axial side of the metal-to-metal seal opposite from the first sleeve, and wherein the first sleeve is responsive to a hydraulic actuation to move axially toward the second sleeve to axially compress and radially expand the metal-to-metal seal into a set state relative to the tubular components of the mineral extraction system, and wherein the second sleeve is configured to be disposed within the first tubular component and between the first tubular component and the second tubular component;

a first elastomer seal and a second elastomer seal separate from the metal-to-metal seal, wherein the first elastomer seal couples to the inner surface of the second sleeve and the second elastomer seal couples to the outer surface of the second sleeve to provide sealing while setting the metal-to-metal seal; and a retainer ring coaxial with the first and second sleeves, wherein the retainer ring is configured to move axially in response to rotation to hold the first sleeve in position with respect to the second sleeve such that the metal-to-metal seal remains in the set state.

2. The system of claim 1, comprising a tool coupleable to the seal assembly within the first tubular, the tool comprising a piston configured to actuate the first sleeve within the first tubular in response to applied hydraulic pressure.

3. The system of claim 1, wherein the retainer ring is secured via the rotation by engaging internal threads within the first tubular.

4. The system of claim 1, wherein the metal-to-metal seal comprises two concentric metal rings having complimentary frusto-conical surfaces configured to slide along one another.

5. The system of claim 1, comprising the first and second tubular components.

6. The system of claim 5, wherein the tubular components comprise a spool, a hanger, a tree, or a combination thereof.

7. The system of claim 1, wherein the retaining ring surrounds the first and second sleeves.

8. The system of claim 1, wherein the first sleeve comprises a first portion radially offset from a second portion, and wherein the first portion and the second portion of the first sleeve contact the metal-to-metal seal.

9. A system, comprising:

a seal assembly configured to seal between a first tubular component and a second tubular component of a mineral extraction system, the seal assembly comprising:

a metal-to-metal seal comprising a first annular portion coaxial with a second annular portion and interfacing one another along respective frustoconical surfaces;

a first sleeve disposed on a first axial side of the metal-to-metal seal;

a second sleeve comprising an inner surface and an outer surface, wherein the second sleeve is disposed on a second axial side of the metal-to-metal seal opposite from the first sleeve, and wherein the first sleeve is configured to only move axially within a bore of the first tubular component toward the second sleeve to axially compress and radially expand the metal-to-metal seal into a set state relative to the tubular components of the mineral extraction system;

a first seal and a second seal, wherein the first seal couples to an inner surface of the second sleeve and the second seal couples to the outer surface of the second sleeve to provide sealing while setting the metal-to-metal seal; and a retainer ring coaxial with the first and second sleeves, wherein the retainer ring is configured to move axially in response to rotation to hold the first sleeve in position with respect to the second sleeve such that the metal-to-metal seal remains in the set state.

10. The system of claim 9, wherein the retaining ring surrounds the outer surface of the first sleeve.

11. The sleeve of claim 9, wherein the first sleeve comprises a first portion radially offset from a second portion, and wherein the first portion and the second portion of the first sleeve contact the metal-to-metal seal.

12. The system of claim 11, wherein the retainer ring contacts the first portion and the second portion of the first sleeve.

13. The system of claim 9, wherein the first sleeve axially overlaps and directly contacts the second sleeve.

14. A system, comprising:

a seal assembly configured to seal tubular components of a mineral extraction system, the seal assembly comprising:

a metal-to-metal seal comprising a first annular portion coaxial with a second annular portion and interfacing one another along respective frustoconical surfaces, wherein the metal-to-metal seal directly contacts and seals against a tubing hanger;

a first sleeve disposed on a first axial side of the metal-to-metal seal;

a second sleeve comprising an inner surface and an outer surface, wherein the second sleeve is disposed on a second axial side of the metal-to-metal seal opposite from the first sleeve, and wherein the first sleeve is configured to move toward the second sleeve to axially compress and radially expand the metal-to-metal seal into a set state relative to the tubular components of the mineral extraction system;

a first seal and a second seal, wherein the first seal couples to an inner surface of the second sleeve and the second seal couples to the outer surface of the second sleeve to provide sealing while setting the metal-to-metal seal; and a retainer ring coaxial with the first and second sleeves, wherein the retainer ring is configured to move axially in response to rotation to hold the first sleeve in position with respect to the second sleeve such that the metal-to-metal seal remains in the set state.

15. The system of claim 14, wherein the first sleeve is configured to surround a tool body.

16. The system of claim 14, wherein the first sleeve is configured to form a hydraulic chamber with a tool body.

17. The system of claim 14, wherein the first sleeve comprises a first portion radially offset from a second portion.

18. The system of claim 17, wherein the retainer ring directly contacts the first portion and the second portion of the first sleeve.

* * * * *